United States Patent [19]

Crawford

[11] Patent Number: 4,740,731

[45] Date of Patent: Apr. 26, 1988

[54] TWO CAPACITOR APPARATUS FOR SEQUENTIAL STARTING AND OPERATION OF MULTIPLE SERIES CONNECTED DISCHARGE LAMPS

[75] Inventor: Joseph A. Crawford, Chicago, Ill.

[73] Assignee: Advance Transformer Company, Chicago, Ill.

[21] Appl. No.: 935,489

[22] Filed: Nov. 26, 1986

[51] Int. Cl.[4] ..... H05B 41/16

[52] U.S. Cl. ..... 315/141; 315/144; 315/276; 315/227 R; 315/DIG. 5; 336/178

[58] Field of Search ..... 315/178, 276, 227 R, 315/DIG. 5, 144, 138, 229, 239, 141; 336/178

[56] References Cited

U.S. PATENT DOCUMENTS

| | | | |
|---|---|---|---|
| 2,558,293 | 6/1951 | Feinberg | 315/138 |
| 2,682,014 | 6/1954 | Feinberg | 315/138 |
| 3,069,597 | 12/1962 | Feinberg | 336/178 |
| 3,077,570 | 2/1963 | Popa | 336/178 |
| 3,111,637 | 11/1963 | Ovletta | 336/178 |
| 3,198,983 | 8/1965 | Feinberg | 315/DIG. 5 |
| 3,582,709 | 9/1967 | Furui | 315/99 |

*Primary Examiner*—David K. Moore
*Assistant Examiner*—Michael Razavi
*Attorney, Agent, or Firm*—David R. Treacy; Bernard Franzblau

[57] ABSTRACT

Apparatus for sequentially igniting and serially operating a pair of electric discharge lamps from a source of AC supply voltage. The apparatus includes a transformer with a primary winding and first and second secondary windings mounted on a magnetic core having a slot under the second secondary winding. The first secondary winding has a high leakage reactance and the windings are serially connected with the secondary windings wound in opposition to one another. First and second capacitors are connected in series with the first and second lamps, respectively, to prevent the flow of DC current therethrough. By a novel choice of the ratios of the capacitance values of the second capacitor to the first capacitor and of the slot dimensions, superior operating characteristics for the apparatus are achieved.

20 Claims, 1 Drawing Sheet

TWO CAPACITOR APPARATUS FOR SEQUENTIAL STARTING AND OPERATION OF MULTIPLE SERIES CONNECTED DISCHARGE LAMPS

BACKGROUND OF THE INVENTION

This invention relates to apparatus for starting and operating a plurality of electric discharge lamps, such as fluorescent lamps or the like. More particularly, the invention is directed to such apparatus which is more reliable than similar prior art apparatus in that it prevents burn-out of the ballast transformer windings in the case of a malfunction of a discharge lamp.

U.S. Pat. No. 2,558,293 (A. E. Feinberg, 6/26/51) describes a ballast apparatus for starting and operating two gas discharge lamps in series with sequential starting of the lamps. That ballast comprises a three-winding transformer having a primary winding P, a first secondary winding $S_1$ and a second secondary winding $S_2$, all of the winding being connected serially in the order named with the secondary windings arranged in voltage bucking relationship to one another. The windings are all mounted on a unitary elongate magnetic core side by side, with the two secondary windings on opposite sides of the primary winding. A magnetic shunt is provided between the first (start) winding designated $S_1$ and the primary winding P. The primary winding P and the first (start) winding $S_1$ are loosely coupled which provides a relatively high leakage reactance. A first discharge lamp is connected in series with a capacitor across the series connection of the primary winding P and the start winding $S_1$. The second lamp is connected across the series connection of the first ($S_1$) and second ($S_2$) secondary windings. FIG. 4 of the patent shows a variation thereof and other variations are also possible. In general, one gas discharge lamp is connected across windings excluding the second secondary $S_2$ and including at least the first secondary $S_1$, and a second gas discharge lamp is connected across windings which include at least both of the secondary windings.

In operation, when the primary winding P is energized by the AC supply voltage, a voltage will be produced in both the primary winding P and the first secondary winding $S_1$ which will be sufficient to ignite the first gas discharge lamp. As a result, current will flow through the start winding $S_1$ and, because of its high leakage reactance, a voltage will be produced therein of a phase such as to produce a substantial voltage component additive relative to the voltage induced in the second secondary winding $S_2$. Thus, the second gas discharge lamp will now ignite. With both of the discharge lamps operating, there will be a series path for the major portion of the current through the lamps and the second secondary winding $S_2$. The first secondary winding $S_1$ is effectively bypassed because its high leakage reactance impedes the flow of current therethrough. Therefore, the winding $S_1$ can be, and in commercial versions has been made of a large number of turns of very fine wire since it carries so little current during operation. The two lamps are ignited in sequence and thereafter are operated in series from the AC supply voltage via the secondary winding $S_2$ and the aforesaid capacitor. The resultant ballast is very small and compact, provides high efficiency and high power factor operation, and generates very high lamp ignition voltages with relatively little copper.

Although ballast devices designed in accordance with the above-described U.S. patent performed successfully for many years, a problem occurred after a long period of lamp operation. The second to start lamp lost emission material from one of its cathodes so that it then operated as a rectifying tube. In that case a rectified current flowed in the circuit, essentially a pulsed DC current. This current could not pass through the series capacitor and consequently was forced to flow through the start winding $S_1$. The amplitude of current that flowed in the start winding was much higher than the current for which this winding was designed. Since the start winding was designed to withstand relatively low currents, it would either heat up excessively or burn out. The ballast would then have to be replaced at considerable expense and inconvenience.

In order to solve this problem, Feinberg invented a ballast apparatus which issued as U.S. Pat. No. 2,682,014 (6/22/54). This patent proposed to add a second capacitor $C_2$ connected in series with the second secondary winding $S_2$ in order to prevent the flow of rectified (DC) current through the second discharge lamp. This ballast circuit therefore provided a first capacitor $C_1$ in series with the first lamp and a second capacitor $C_2$ in series with the second lamp (and also in series with the second secondary winding $S_2$). Each of these capacitors had a capacitance value of approximately twice the capacitance value of the single series capacitor of the earlier Feinberg patent (U.S. Pat. No. 2,558,293).

In the event that the second lamp became a rectifier, the two capacitor ballast circuit was quite effective in preventing the flow of DC current in each of the lamps since each lamp now had a capacitor connected in series therewith to block any DC current flow therein. The flow of rectifying current through the secondary windings also was blocked, thus protecting the start winding $S_1$ from burn-out. Although the two capacitor ballast circuit was effective in protecting the transformer secondary winding ($S_1$) from failure, the resultant apparatus was too expensive to compete against other commercial ballast devices. In addition, the two capacitor ballast produced an unacceptable difference in the current and power the two capacitor ballast avoided the problems associated with lamp rectification operation, it did not provide a practical and commerically competitive apparatus.

A further attempt to cure the problems associated with the one and two capacitor ballast devices described above resulted in a delta arrangement of three capacitors described in U.S. Pat. No. 3,198,983 (8/3/65), also in the name of A. E. Feinberg. The capacitance values were then chosen so that the normal operating current still flowed through each of the lamps and without a material change in the existing core lamination or the transformer windings. Once again, although the three-capacitor ballast provided the required ballast protection, it also was too expensive for widespread commercial use.

In recent years a new form of lamp has come into widespread use, the so-called energy saver lamp. A characteristic of this lamp is that it is more susceptible to a loss of cathode emissive material and therefore to the lamp rectification problem described above. It has been found that in the case of a 60 watt energy saver lamp the DC current that flows in the event of lamp rectification is greater than that present with a standard 75 watt lamp. As a consequence, there have been more ballast failures with energy saver lamps than was previously experienced with the conventional discharge lamps.

A first attempt to solve the lamp rectification problem in energy saver lamps utilized the systems shown in U.S. Pat. No. 2,682,014, but the results were unsatisfactory because the starting currents proved to be too low to reliably ignite the lamps. In addition, there was a considerable imbalance in the currents between the first and second discharge lamps, which of course is undesirable from a lighting standpoint and to meet the standards required for lamp output.

SUMMARY OF THE INVENTION

The present invention is closely related in operation and function but is an improvement over the ballast apparatus described in U.S. Pat. Nos. 2,558,293 and 2,682,014, wherefore this application incorporates by reference the subject matter of these two patents.

In accordance with a first preferred embodiment of the invention I provide a two capacitor ignition and ballast apparatus similar to that shown in U.S. Pat. No. 2,682,014 in which two capacitors are utilized in series during operation of the lamps, and with only one capacitor in series with the starting circuit. The second capacitor is in series with the main winding ($S_2$). By means of extensive investigations and tests, I have discovered that significantly improved results can be obtained by limiting the capacitance values of the first and second capacitors $C_1$ and $C_2$ (in series with the first and second lamps, respectively) so that they do not differ from one another by more than 30%, i.e. the capacitor $C_2$ (in series with the main operating winding $S_2$) can be up to 30% larger than the capacitor $C_1$ in series with the start winding $S_1$. The range of capacitance values which provide the improved operation is from $C_2=C_1$ to $C_2=1.3C_1$. Attempts to use equal value capacitors in the apparatus of U.S. Pat. No. 2,682,014 resulted in too great a difference in the current and power between the first and second lamps.

I have further discovered that the two capacitor ignition/ballast apparatus exhibits significantly better characteristics if a slot is provided in the transformer magnetic core structure under the second secondary winding and in which the transverse dimension of the slot is in the range of 25–50% of the core cross section. In an apparatus designed in accordance with U.S. Pat. No. 2,682,014 it was determined that the transverse width of the slot should be 65% of the core width. In contrast, a slot width of 35% of the core width in an apparatus in accordance with the present invention produced an apparatus with superior operating characteristics. More particularly, the lamp balance and capacitor voltages can be adjusted by a proper choice of the slot width and length.

A further feature of the invention is that the ratio of the transformer winding turns of winding $S_1$ to the winding $S_2$ is only approximately 1.53, whereas in U.S. Pat. No. 2,682,014 the turns ratio of the start winding to the operating winding was about 1.86. In addition, my invention provides a reduction in the leakage reactance of both the start winding $S_1$ and the operating winding $S_2$ in comparison with the apparatus of U.S. Pat. No. 2,682,014. In fact, the leakage reactance of the start winding of my improved apparatus does not exceed 4,000 Ohms, and is approximately 70% of the leakage reactance required to operate the two lamps in a one capacitor starting and operating apparatus.

Tests on the apparatus in accordance with the invention revealed a slight but acceptable imbalance of the capacitor voltages, e.g. 277 volts across one capacitor and 308 volts across the other.

It is therefore an object of the invention to provide an improved two capacitor apparatus for starting (in seriatim) and operating a pair of discharge lamps that avoids the drawbacks of, and provides improved electrical characteristics over, the prior art apparatus.

Another object of the invention is to provide apparatus of the character described which prevents the flow of a rectified current through the transformer secondary windings in the event one of the discharge lamps operates in a rectifying mode.

A further object of the invention is to provide a two capacitor ballast apparatus in which $C_1$ and $C_2$ are chosen so that $C_2$ lies in the range of values between $C_1$ and 1.3 $C_1$, and with a minimum imbalance of the currents and power in the first and second discharge lamps.

Another object of the invention is to provide a two capacitor ballast apparatus which can satisfactorily ignite and operate either a pair of instant start lamps or a pair of energy saver lamps while maintaining a current balance in either pair of lamps.

Further investigation of the problems associated with the prior art two capacitor ballast apparatus resulted in the discovery that by connecting the start winding $S_1$ to a tap on the primary winding and by the proper choice of the slot dimensions, an improved apparatus was achieved having good lamp balance, a lower current in the start winding, a higher open circuit voltage for igniting the second lamp and lower voltages across the first and second capacitors ($C_1$ and $C_2$). A slot in the core under the transformer secondary winding ($S_2$) having a transverse slot width approximately 35% of the core width provided very good results. Best results were achieved by limiting the capacitance value of $C_2$ to a range of values between 1.1 $C_1$ and 1.5 $C_1$. A further improvement was obtained by reducing the number of turns of the start winding $S_1$.

It was further discovered that in the case of a 120 volt ballast, the number of primary winding turns required to start the lamps is only approximately one-half the turns utilized in a one capacitor ballast. In fact, with a 120 volt AC supply voltage, only 60 volts of the primary is required to be added to the voltage of the start winding $S_1$ in order to provide good lamp ignition and operation.

Another interesting discovery was that the ignition voltage required for starting the second lamp is a function of the ratio of the two capacitors ($C_1$ and $C_2$). It was found that the open circuit voltage across the second lamp drops appreciably where a large capacitance ratio of $C_2$ to $C_1$ is used (e.g. 3:1). In contrast, when $C_2$ was only 30% greater than $C_1$, the open circuit voltage across the second lamp was appreciably improved. The use of the new slot dimensions discussed above also contributed to the higher open circuit voltage across the second lamp. The prior art slot with a transverse width of 65% of the core width was unsatisfactory, whereas a 35% ratio provided much better ballast characteristics. The prior art slot had a ratio of transverse length to slot width of approximately 17, whereas the corresponding slot ratio in accordance with the invention is only about 2.57. The open circuit voltage across the second lamp to start is reduced as the ratio of the two capacitors approaches unity.

In the embodiment of the invention employing a tapped primary winding, best results are achieved when the ratio of the second capacitor ($C_2$) to the first capacitor ($C_1$) lies in the range of 1.1 to 1.5. The ignition voltage for the first lamp is provided by the voltage from the primary tap plus the voltage of the secondary start winding $S_1$. The path of the two lamps in series includes a portion of the primary winding. The voltage of the first-to-start lamp includes a smaller portion of the primary voltage. The transverse dimension of the slot under the secondary winding lies in the range of 25–50% of the core cross section.

The invention can also be used with the embodiment shown in FIG. 4 of U.S. Pat. No. 2,682,014, in which case the path of the two lamps in series includes the full primary and secondary voltages with the voltage across the first to start lamp reduced by the tap on the primary winding.

It is therefore a further object of the invention to improve the prior art ballast apparatus by connecting the start winding to an appropriate tap on the primary winding and by providing a modified slot under the main secondary winding in the magnetic core of the transformer.

BRIEF DESCRIPTION OF THE DRAWINGS

The objects, advantages and features of the invention will be better understood by reference to the following detailed description taken in conjunction with the accompanying drawings in which.

DESCRIPTION OF THE PREFERRED EMBODIMENTS

Figure 1:
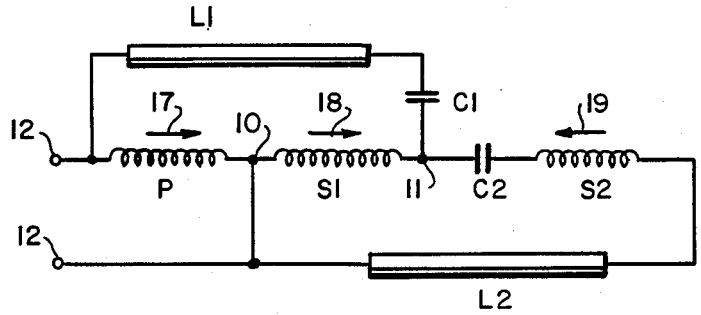
FIG. 1 is an electrical circuit diagram of an apparatus of a first embodiment of the invention.
Figure 2:
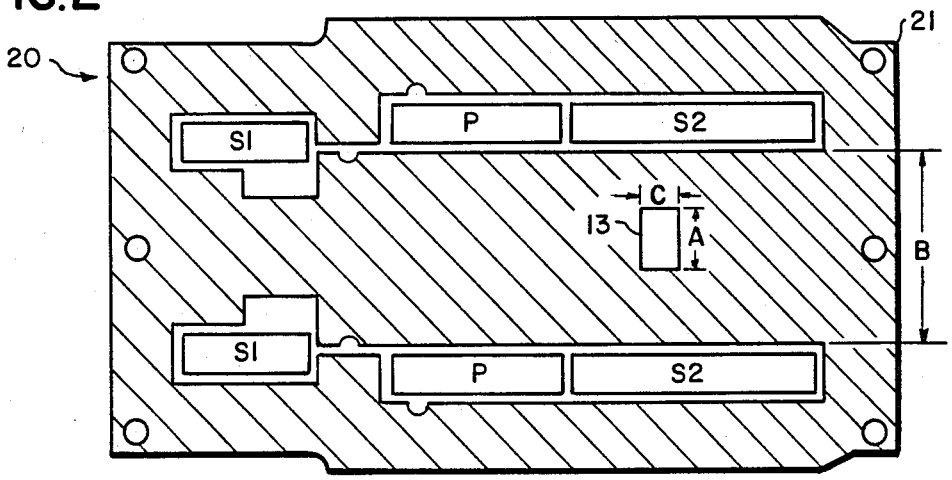
FIG. 2 illustrates the physical layout of the windings on the magnetic core of the transformer in FIG. 1.

Referring now the drawings in which like reference symbols throughout the several figures represent the same or similar parts, FIG. 1 illustrates the basic circuit configuration of the apparatus described in U.S. Pat. No. 2,682,014, but modified in accordance with the present invention so as to achieve the improved results and the objects described above. FIG. 2 shows the important details of the transformer construction in accordance with the invention.

The transformer 20 consists of three windings, a primary winding P, a first secondary winding $S_1$ (start winding), and a second secondary winding $S_2$ (main operating winding), all electrically connected end to end in the order named. These windings are mounted in windows of a laminated core 21 made of a magnetic material, e.g. iron, in the manner shown in FIG. 2. The primary winding P is mounted on the magnetic core between the secondary windings $S_1$ and $S_2$, winding $S_1$ being mounted on the left in FIG. 2 and winding $S_1$ on the right. A magnetic shunt separates the primary winding and the secondary start winding $S_1$ in the manner disclosed in the above-mentioned U.S. Pat. No. 2,558,293 and 2,682,014.

The magnetic shunt provides the winding $S_1$ with a high leakage reactance. The main secondary winding $S_2$ is also loosely coupled to the primary winding P, but more tightly coupled than is the first (start) winding $S_1$. A small magnetic shunt could also be provided, if desired, between the primary winding and the second secondary winding $S_2$ in order to increase the leakage reactance of winding $S_2$.

The primary winding P and the first secondary winding $S_1$ are wound in the same direction to provide additive voltages, whereas the second secondary winding $S_2$ is wound in the opposite direction to provide a subtractive voltage. The voltage (winding) sense of the windings relative to one another is indicated by the arrows 17, 18 and 19 adjacent the respective windings.

The windings are connected in series with junction points 10 and 11 between windings P and $S_1$ and between windings $S_1$ and $S_2$, respectively.

A pair of input terminals 12 are adapted to be connected to a source of low frequency AC supply voltage, for example, 120 V at 60 Hz (not shown). A first discharge lamp $L_1$ is connected in series circuit with a first capacitor $C_1$ between one of the input terminals and the junction point 11. A second capacitor $C_2$ is connected in a series circuit with the main secondary winding $S_2$ and a second discharge lamp $L_2$ between the junction points 11 and 10. The lamps $L_1$ and $L_2$ may be fluorescent lamps.

It will be apparent that the first lamp $L_1$ is connected via capacitor $C_1$ across the primary winding P and the first secondary winding $S_1$ of the transformer 20. The second lamp $L_2$ is connected across the first and second secondary windings $S_1$ and $S_2$. Thus, the very loosely coupled secondary winding $S_1$ is common to the circuits of each of the lamps $L_1$ and $L_2$.

Each of the secondary windings has more turns than the primary winding so that they step-up the AC supply voltage applied to the input terminals 12. The first winding $S_1$ has more turns than the second winding $S_2$. For a detailed description of the manner in which the lamps are sequentially ignited (lamp $L_1$ first, lamp $L_2$ second) and then operated in series, reference may be made to the Feinberg patents mentioned above. Briefly, when the AC voltage at terminals 12 is applied to the primary winding P, an additive voltage is induced in the start winding $S_1$. The resultant of the primary voltage and the voltage of the start winding $S_1$ appears across the first lamp $L_1$ and is sufficient to ignite this lamp. Since the voltage induced in the main winding $S_2$ opposes that induced in the start winding $S_1$, the resultant voltage across these two windings is initially insufficient to ignite the second lamp $L_2$.

After ignition of lamp $L_1$, current flows through the lamp $L_1$ and the first secondary winding $S_1$. In view of the high leakage reactance of $S_1$, and the presence of capacitor $C_1$, a phase shift is produced such that the voltage that occurs in winding $S_1$ as a result of the flow of current includes a component that is additive to the voltage induced in winding $S_2$ by the primary winding P. The combined effect of the additive voltage component in winding $S_1$ and the induced voltage in winding $S_2$ is now sufficient to ignite the second lamp $L_2$ and allow current to flow therein.

With current flowing through both of the lamps, the relatively high inductive reactance of the start winding $S_1$ serves to oppose the flow of current therethrough. Thus, in the operating condition of the lamps, current will flow in a series circuit that includes the lamps $L_1$ and $L_2$, the capacitors $C_1$ and $C_2$ and the main secondary winding $S_2$. Since most of the operating current will bypass the winding $S_1$, it can be made of a fine wire with a large number of turns. Under normal operating conditions, the apparatus of FIG. 1 will operate in the same way as that of U.S. Pat. No. 2,682,014.

In the event that one of the cathodes of lamp $L_2$ loses its emissive material, the lamp will then operate as a rectifier and a DC current will attempt to flow through this lamp and capacitor $C_2$ in series therewith. However, the capacitor $C_2$ will prevent this flow of DC current and thereby prevent the excessive current flow in winding $S_1$ that caused it to burn out in the one capacitor apparatus of U.S. Pat. No. 2,558,293.

As discussed above, by limiting the relative capacitance values of capacitors $C_1$ and $C_2$ so that $C_2$ lies in the range of values from $C_2=C_1$ to $C_2=1.3\ C_1$, the apparatus in accordance with the invention provides an unexpected improvement in the current balance between the two lamps. Furthermore, a slot 13 is provided in the magnetic core 21 under the main secondary winding $S_2$. The slot has a transverse width dimension A of 25–50% (preferably 35%) of the core width dimension B in FIG. 2. This particular slot also serves to improve the lamp current balance, as well as provide other improvements in the operating characteristics of the apparatus, e.g. a reduction in capacitor voltage and an increase in the open circuit voltage for lamp $L_2$.

Typical dimensions are a slot width A of 0.45" and a core dimension B of 1.3". In contrast, the prior art apparatus used a slot width of 0.85" with a core width of 1.3", hence a 65% ratio of dimension A to B. Typical values for the capacitor $C_1$ and $C_2$ in FIG. 1 are $C_1=3.0$ $\mu$F and $C_2$ in the range of 3.0 $\mu$F to 3.9 $\mu$F. It is of course preferable for $C_1$ to equal $C_2$ since this reduces inventory problems and makes assembly of the apparatus easier.

In the case of a system using energy saver lamps, the apparatus shown in U.S. Pat. No. 2,682,014 was unsatisfactory since the starting currents were too low to reliably ignite the lamps, in addition to a substantial imbalance of the currents in the two lamps. The capacitance values for $C_1$ and $C_2$ and the slot dimensions referred to above solve these problems and produce a satisfactory apparatus for igniting and operating a pair of energy saver lamps.

Figure 3:
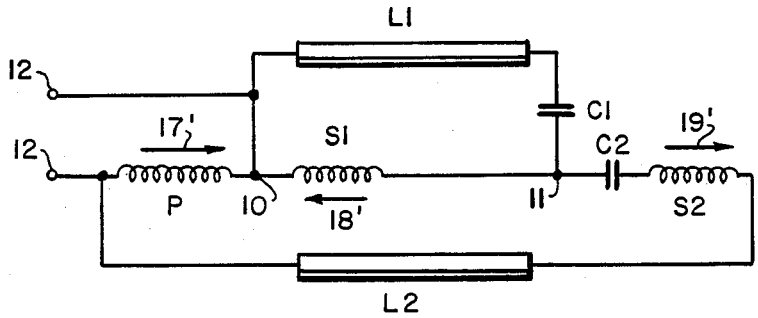
FIG. 3 is an electrical circuit diagram of a modified form of the apparatus of FIG. 1.

FIG. 3 shows a modified form of the invention shown in FIG. 1. This embodiment is similar to FIG. 4 of U.S. Pat. No. 2,682,014, except that it is uniquely modified in accordance with the invention to provide the various objects and advantages described above and below. The arrangement of the windings is the same as that described in FIG. 1 except that now the windings are wound to produce the voltage sense indicated by the arrows 17', 18', and 19' in FIG. 3. The voltage in the primary winding P is in the same sense as the voltage in the main secondary winding $S_2$, whereas the voltage in start winding $S_1$ is opposed to the voltages in windings P and $S_2$. The lamp $L_1$ is connected only across the start winding $S_1$ via the capacitor $C_1$. The lamp $L_2$ is now connected across all three windings. The capacitor $C_2$ is again connected between winding $S_2$ and the junction point 11.

When the AC supply voltage (e.g. 120 V, 60 Hz) is applied to input terminals 12, the resultant voltage across all three windings in series is insufficient to ignite lamp $L_2$ since the voltage of winding $S_1$ is opposed to the voltages across windings P and $S_2$. The voltage induced in start winding $S_1$ is, however, sufficient to ignite lamp $L_1$. Thereafter, due to the relatively high leakage reactance of winding $S_1$, a voltage is produced across $S_1$ having a component additive to the voltages of the primary winding P and the secondary winding $S_2$. The lamp $L_2$ then ignites.

In normal operation, current flows through the lamps $L_1$ and $L_2$ in series. In the event lamp $L_2$ becomes defective and begins to rectify, the capacitor $C_2$ will again block the flow of a DC current and thus prevent burnout of the winding $S_1$ in a manner similar to that described above in connection with FIG. 1.

In accordance with the invention, capacitor $C_2$ will be in the range of capacitance values from $C_2=C_1$ to $C_2=1.3\ C_1$. The slot width (A in FIG. 2) is again 25–50% of the core width (B in FIG. 2). In addition, further improvement in the apparatus results when $C_1=C_2$ and with the turns of the start winding $S_1$ not exceeding the turns of the main operating winding $S_2$ by more than 40–60%.

A particularly advantageous arrangement of the invention utilized capacitors $C_1$ and $C_2$ of approximately 3.35 $\mu$F each, a primary winding P having 427 turns, a start winding $S_1$ with 2754 turns and a main secondary winding $S_2$ of 1792 turns. The AC supply voltage was 120 V, 60 Hz and the impedance of the start winding did not exceed 4000 Ohms. It was also found that there was a reduction in the leakage reactance of both the start winding $S_1$ and the operating winding $S_2$. There was a slight variation in the capacitor voltages, with 277 volts across one capacitor and 308 volts across the other. In contrast, a one capacitor apparatus using a 1.9 $\mu$F capacitor produced a voltage of 575 volts across the single capacitor.

The turns ratio of winding $S_1$ to winding $S_2$ is approximately 1.53, whereas in U.S. Pat. No. 2,682,014 the corresponding turns ratio was approximately 1.86.

It is of course possible to relocate capacitor $C_2$ so that it is connected between the junction point 11 and the right end terminal of start winding $S_1$. In the case of a 277 volt AC supply voltage, it is advantageous to connect the left hand terminal of lamp $L_2$ to a tap on the primary winding P instead of to the input terminal 12. In this case, the primary winding preferably has 427 turns between the tap point and junction point 10 and 544 turns between the tap point and the input terminal 12. The same 427 turns of primary winding are utilized in the main circuit including lamps $L_1$ and $L_2$, and an additional 544 primary turns is used in series with the 427 turns to accommodate the 277 supply voltage.

Figure 4:
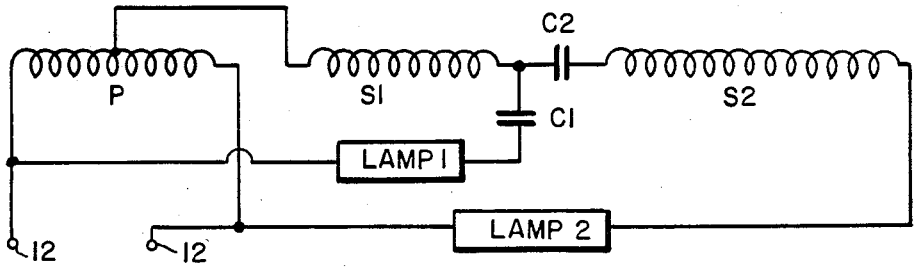
FIG. 4 is an electrical circuit diagram of a further embodiment of the invention.

FIG. 4 shows a further embodiment of the invention which is a modification of FIG. 1 wherein the start winding $S_1$ is connected to a tap on the primary winding P. A pair of input terminals 12 are provided for connection to a source of AC supply voltage, e.g. 120 V, 60 Hz. The circuit connections in FIG. 4 are the same as in FIG. 1 except that now the second-to-start lamp $L_2$ is connected across windings $S_1$ and $S_2$ and a portion of the primary winding P. In accordance with the invention, the slot 13 was modified over the prior art slot (0.85"×0.05") so that the dimension A was reduced to 0.45" and dimension C was changed to 0.225". The center line of slot 13 was 2.18" from the right hand edge of core 21, and the overall core length between the left and right edges was 7.144". The transverse slot dimension A is again approximately 35% of the core width dimension B.

In one embodiment, the primary winding contained 223 turns on either side of the tap point, 2654 turns in winding $S_1$ and 1,792 turns in winding $S_2$. The capacitor $C_2$ ranged in value from $C_2=1.1\ C_1$ to $C_2=1.5\ C_1$. Only 60 V of the 120 V supply voltage is utilized as an additive to the start winding in order to provide good results. The ignition voltage for starting the lamp $L_2$ is a function of the ratio of the capacitors $C_2$ to $C_1$. The open circuit voltage across lamp $L_2$ is appreciably improved when $C_2$ is 30% greater than $C_1$, along with the slot dimensions indicated. The prior art ratio of slot dimensions, i.e. transverse length to slot width was approximately 17, whereas the new ratio was only 2. The ignition voltage for lamp $L_1$ is provided by the voltage across the secondary winding $S_1$ plus the tap voltage of the primary winding. The transverse slot dimension is in the range of 25–50% of the core cross-section.

The apparatus of FIG. 4 comprising a tapped primary winding, modified slot dimensions and a limited range of values for capacitors $C_1$ and $C_2$ provides significant advantages over the prior art apparatus, to wit a much better balance of the lamp currents, a lower abnormal current in the start winding, a higher open circuit voltage for the second lamp $L_2$ and lower voltages across capacitors $C_1$ and $C_2$.

While the invention has been described in accordance with certain preferred embodiments thereof, various modifications and changes may be effected by those skilled in the art. Accordingly, it is intended that the appended claims cover all such modifications and changes as fall within the spirit and scope of the invention.

I claim:

1. Apparatus for igniting and operating at least two electric discharge lamps from a source of AC voltage less than the ignition voltage of the lamp comprising: a pair of input terminals for connection to the AC voltage source, a transformer having a magnetic core having a primary winding and first and second secondary windings wound on the core with the first and second secondary windings wound in opposite sense to develop voltages in opposed relationship to each other, first and second capacitors, the primary winding, the first secondary winding, the second capacitor and the second secondary winding being connected in series, the magnetic core having a slot formed therein under the second secondary winding, first means for connecting a first lamp in series with the first means across at least the first secondary winding, second means for connecting the second lamp across at least the second secondary winding, and means for coupling the primary winding to said input terminals, and wherein the transverse dimension of the slot lies within the range of 25–50% of the core width dimension.

2. An apparatus as claimed in claim 1 wherein the first and second capacitors have capacitance values $C_1$ and $C_2$, respectively, such that $C_2$ lies within the range of capacitance values $C_2=C_1$ to $C_2=1.3\ C_1$.

3. An apparatus as claimed in claims 1 or 2 wherein the first secondary winding is mounted on the core so that it is loosely coupled to the primary winding so as to provide a high leakage reactance.

4. An apparatus as claimed in claims 1 or 2 wherein the first connecting means connects the first lamp and first capacitor across a series connection of the primary winding and the first secondary winding, and the second connecting means connects the second lamp across a series connection of the first and second secondary windings.

5. An apparatus as claimed in claims 1 or 2 wherein the first connecting means connects the first lamp and the first capacitor across the first secondary winding, and the second connecting means connects the second lamp across a series connection of the primary winding and the first and second secondary windings.

6. An apparatus as claimed in claim 1 wherein, one end of the first secondary winding is connected to an intermediate tap point on the primary winding, said first connecting means connects the first lamp and the first capacitor across the first secondary winding and a part of the primary winding between the tap point and one end terminal of the primary winding, and said second connecting means connects the second lamp across a series connection of the first and second secondary windings and a part of the primary winding between the tap point and the other end terminal of the primary winding.

7. An apparatus as claimed in claim 6 wherein the first and second capacitors have capacitance values $C_1$ and $C_2$, respectively, such that $C_2$ lies within the range of capacitance values $C_2=1.1\ C_1$ to $C_2=1.5\ C_1$.

8. An apparatus as claimed in claim 6 wherein the ratio of the transverse slot dimension to the longitudinal slot dimension is approximately 2:1.

9. An apparatus as claimed in claims 1 or 2 wherein the capacitance of the first capacitor, $C_1$, is approximately equal to the capacitance of the second capacitor, $C_2$, and the number of turns $T_1$ of the first secondary winding is in the range of $1.4\ T_2$ to $1.6\ T_2$, where $T_2$ is the number of turns of the second secondary winding.

10. An apparatus as claimed in claims 1 or 2 wherein the impedance of the first secondary winding does not exceed 4000 ohms at the frequency of the AC supply voltage, and wherein in normal operation of the two lamps a current flows in a series circuit that includes the two lamps, the first and second capacitors and the second secondary winding.

11. An apparatus as claimed in claims 1 or 2 wherein the primary winding is mounted on the core between the first and second secondary windings.

12. Apparatus for igniting and operating at least two electric discharge lamps from a source of AC voltage comprising: a pair of input terminals for connection to the AC voltage source, a transformer having a magnetic core and a primary winding having a tap point and first and second secondary windings wound on the core with the first and second secondary windings wound in opposite sense to develop voltages in opposed relationship to each other, first and second capacitors, means serially connecting the first secondary winding, the second capacitor, the second secondary winding and a part of the primary winding between said tap point and one end terminal of the primary winding, the magnetic core having a slot formed therein under the second secondary winding, first means for connecting a first lamp in series with the first capacitor across at least the first secondary winding, second means for connecting the second lamp across at least the first and second secondary windings, and means for coupling the primary winding to said input terminals, and wherein the transverse dimension of the slot lies within the range of 25–50% of the core width dimension.

13. An apparatus as claimed in claim 12 wherein the first and second capacitors have capacitance values C1 and C2, respectively, such that C2 is approximately equal to 1.3 Cl.

14. An apparatus as claimed in claim 12 wherein the first and second capacitors have capacitance values $C_1$ and $C_2$, respectively, that satisfy the relation $C_1 \leqq C_2 \leqq 1.5\ C_1$.

15. An apparatus as claimed in claim 14 wherein the ratio of the transverse slot dimension to the longitudinal slot dimension is approximately 2:1 and the primary winding is mounted on the core between the first and second secondary windings such that the first secondary winding is loosely coupled to the primary winding so as to provide a high leakage reactance.

16. An apparatus as claimed in claim 12 wherein said first connecting means connects the first lamp in series with the first capacitor across the first secondary winding and the part of the primary winding between said tap point and said one end terminal of the primary winding, and said second connecting means connects the second lamp across a series connection of the first and second secondary windings, the second capacitor and a part of the primary winding between the tap point and the other end terminal of the primary winding.

17. An apparatus as claimed in claim 1 wherein the primary winding is mounted on the magnetic core with the first secondary winding mounted to one side of it and the second secondary winding mounted to the other side of it and with a magnetic shunt formed between the primary winding and the first secondary winding to produce a high leakage reactance.

18. Apparatus for igniting and operating at least two electric discharge lamps in series from a source of AC voltage comprising: a pair of input terminals for connection to the AC voltage source, a transformer having a magnetic core having a primary winding and first and second secondary windings wound on the core with the first and second secondary windings wound in opposite sense, first and second capacitors, first means connecting said first and second secondary windings, said second capacitor and at least a part of the primary winding in a series circuit, second means for connecting the first capacitor in series with the first lamp across at least the first secondary winding, third means for connecting the second lamp across a part of said series circuit including at least the first and second secondary windings and the second capacitor, means for coupling the primary winding to said input terminals, and wherein the magnetic core includes a slot formed therein under the second secondary winding, and the first and second capacitors have capacitance values $C_1$ and $C_2$, respectively, that satisfy the relation $C_1 \leqq C_2 \leqq 1.3C_1$.

19. An apparatus as claimed in claim 18 wherein said slot has a transverse dimension that lies within the range of 25–50% of the width dimension of the core.

20. Apparatus as claimed in claim 18 wherein said apparatus is intended to ignite and operate at least two energy saver type discharge lamps.

* * * * *